US011980993B2

(12) United States Patent
Suzuki

(10) Patent No.: US 11,980,993 B2
(45) Date of Patent: May 14, 2024

(54) METHOD OF GRINDING WORKPIECE

(71) Applicant: DISCO CORPORATION, Tokyo (JP)

(72) Inventor: Yoshikazu Suzuki, Tokyo (JP)

(73) Assignee: DISCO CORPORATION, Tokyo (JP)

( * ) Notice: Subject to any disclaimer, the term of this patent is extended or adjusted under 35 U.S.C. 154(b) by 98 days.

(21) Appl. No.: 17/656,357

(22) Filed: Mar. 24, 2022

(65) Prior Publication Data

US 2022/0314393 A1 Oct. 6, 2022

(30) Foreign Application Priority Data

Apr. 2, 2021 (JP) ..... 2021-063374

(51) Int. Cl.
*B24B 37/27* (2012.01)
*B24B 7/04* (2006.01)
*B24B 7/22* (2006.01)

(52) U.S. Cl.
CPC ..... *B24B 37/27* (2013.01); *B24B 7/04* (2013.01); *B24B 7/228* (2013.01)

(58) Field of Classification Search
CPC ..... B24B 7/228; B24B 7/04; B24B 37/005; B24B 37/042; B24B 37/07; B24B 37/10; B24B 37/105; B24B 34/27; B24B 34/30; B24B 41/068; B24B 47/22; B24B 51/00
USPC ..... 451/285, 287, 405, 414
See application file for complete search history.

(56) References Cited

U.S. PATENT DOCUMENTS 6,656,818 B1 * 12/2003 Kishimoto ..... H01L 21/02013 438/692
6,827,633 B2 * 12/2004 Wada ..... B24B 7/228 257/E21.244
6,969,302 B1 * 11/2005 Hashii ..... B24B 7/228 451/37
8,025,556 B2 * 9/2011 Kajiyama ..... B24B 27/0076 451/41
9,238,288 B2 * 1/2016 Sugiya ..... B24B 1/00

FOREIGN PATENT DOCUMENTS

JP 2014124690 A 7/2014
JP 2018020398 A 2/2018

OTHER PUBLICATIONS

Search report issued in counterpart Singapore patent application No. 10202202597P, dated Aug. 11, 2023.

* cited by examiner

*Primary Examiner* — Brian D Keller
*Assistant Examiner* — Jason Khalil Hawkins
(74) *Attorney, Agent, or Firm* — GREER BURNS & CRAIN, LTD

(57) ABSTRACT

A method of grinding a workpiece includes a first grinding step of adjusting the relative tilt of a chuck table and a grinding wheel to a first state and bringing grindstones into abrasive contact with the workpiece to grind the workpiece, and a second grinding step of adjusting the relative tilt of the chuck table and the grinding wheel to a second state that is different from the first state and bringing the grindstones into abrasive contact with the workpiece to grind the workpiece. In the second grinding step, the workpiece is ground under a condition for causing the workpiece to have a smaller surface roughness than that in the first grinding step.

12 Claims, 9 Drawing Sheets

METHOD OF GRINDING WORKPIECE

BACKGROUND OF THE INVENTION

Field of the Invention

The present invention relates to a grinding method that is applicable to the grinding of a plate-shaped workpiece such as a wafer.

Description of the Related Art

In order to realize small lightweight device chips, there have been a growing number of opportunities for thinning down wafers where devices such as integrated circuits are provided on their face sides. A wafer can be thinned down by holding the face side of the wafer on a chuck table, rotating a grinding wheel that includes a plurality of fixed grindstones containing abrasive grains and the chuck table with respect to each other, and pressing the grindstones against the reverse side of the wafer while liquid such as pure water is being supplied to the wafer (see, for example, JP 2014-124690A).

SUMMARY OF THE INVENTION

One of the grinding processes employed in the art is referred to as "in-feed grinding" where a grinding wheel with grindstones and a chuck table are rotated relatively to each other such that the grindstones move through a rotational axis about which the chuck table is rotated. According to the in-feed grinding, the surface roughness of a central portion of the wafer and the surface roughness of an outer circumferential portion of the wafer tend to be different from each other. Since the difference between the degrees of the surface roughness of the central portion of the wafer and the surface roughness of the outer circumferential portion of the wafer leads to the difference between the degrees of mechanical strength of the devices, it has been desirable to minimize the difference between the degrees of the surface roughness of the central portion of the wafer and the surface roughness of the outer circumferential portion of the wafer after the wafer has been ground.

It is therefore an object of the present invention to provide a grinding method capable of reducing the difference between the degrees of the surface roughness of a central portion of a plate-shaped workpiece and the surface roughness of an outer circumferential portion of the plate-shaped workpiece.

In accordance with an aspect of the present invention, there is provided a method of grinding a plate-shaped workpiece held on a holding surface of a chuck table with a grinding wheel having a plurality of grindstones disposed in an annular array while the chuck table and the grinding wheel are being rotated with the grindstones moving across a rotational axis of the chuck table, the method including a first grinding step of adjusting a relative tilt of the chuck table and the grinding wheel to a first state in which distances between the grindstones and the holding surface are larger in other positions than a position where the grindstones overlap the rotational axis of the chuck table, and moving the holding surface and the grindstones relatively closer to each other to bring the grindstones into abrasive contact with the workpiece to thereby grind the workpiece, a grinding stopping step of spacing the grindstones from the workpiece to stop grinding the workpiece, after the first grinding step, and a second grinding step of adjusting the relative tilt of the chuck table and the grinding wheel to a second state, which is different from the first state, in which the grindstones are held out of contact with the workpiece at a position where the grindstones overlap the rotational axis of the chuck table, and moving the holding surface and the grindstones relatively closer to each other to bring the grindstones into abrasive contact with the workpiece to thereby grind the workpiece, after the grinding stopping step, in which, in the second grinding step, the workpiece is ground under a condition for causing the workpiece to have a smaller surface roughness than that in the first grinding step.

Preferably, the chuck table is rotated at a lower speed in the second grinding step than that in the first grinding step. Preferably, the grinding wheel is rotated at a higher speed in the second grinding step than that in the first grinding step. Preferably, the holding surface and the grindstones are moved closer to each other at a lower speed in the second grinding step than that in the first grinding step.

In an in-feed grinding mode in which both the chuck table and the grinding wheel are rotated such that the grindstones successively move across the rotational axis of the chuck table, the volume of the material ground off an outer circumferential portion of the workpiece per unit time is larger than the volume of the material ground off a central portion of the workpiece per unit time. Consequently, after the workpiece has been ground, the surface roughness of the outer circumferential portion of the workpiece tends to be larger than the surface roughness of the central portion of the workpiece.

In the grinding method according to the aspect of the present invention, the relative tilt of the chuck table and the grinding wheel is adjusted to the first state, and then the workpiece is ground so as to make the central portion thereof thinner (first grinding step). Thereafter, the relative tilt of the chuck table and the grinding wheel is adjusted to the second state that is different from the first state, and then the workpiece is ground so as not to remove the central portion thereof (second grinding step).

In the second grinding step, furthermore, the workpiece is ground under the condition for making the surface roughness smaller than that in the first grinding step. This makes it possible to adjust the surface roughness of the outer circumferential portion of the workpiece to a smaller level, independently of the surface roughness of the central portion of the workpiece. Therefore, the grinding method according to the aspect of the present invention can reduce the difference between the surface roughness of the central portion of the workpiece and the surface roughness of the outer circumferential portion of the workpiece, compared with conventional grinding methods.

The above and other objects, features and advantages of the present invention and the manner of realizing them will become more apparent, and the invention itself will best be understood from a study of the following description and appended claims with reference to the attached drawings showing a preferred embodiment of the invention.

DETAILED DESCRIPTION OF THE PREFERRED EMBODIMENT

Figure 1:
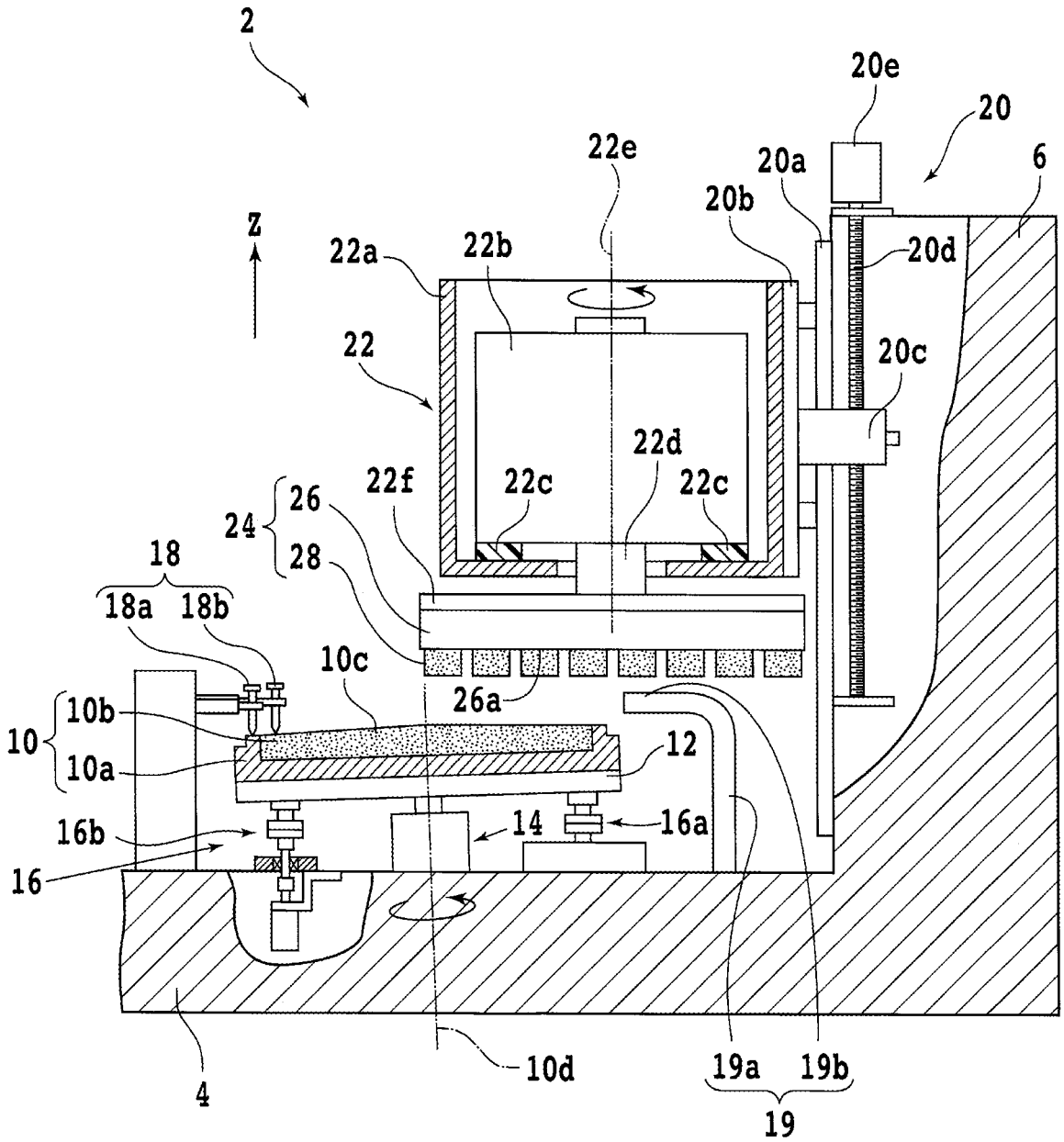
FIG. 1 is a cross-sectional view illustrating a grinding apparatus by way of example.
Figure 2:
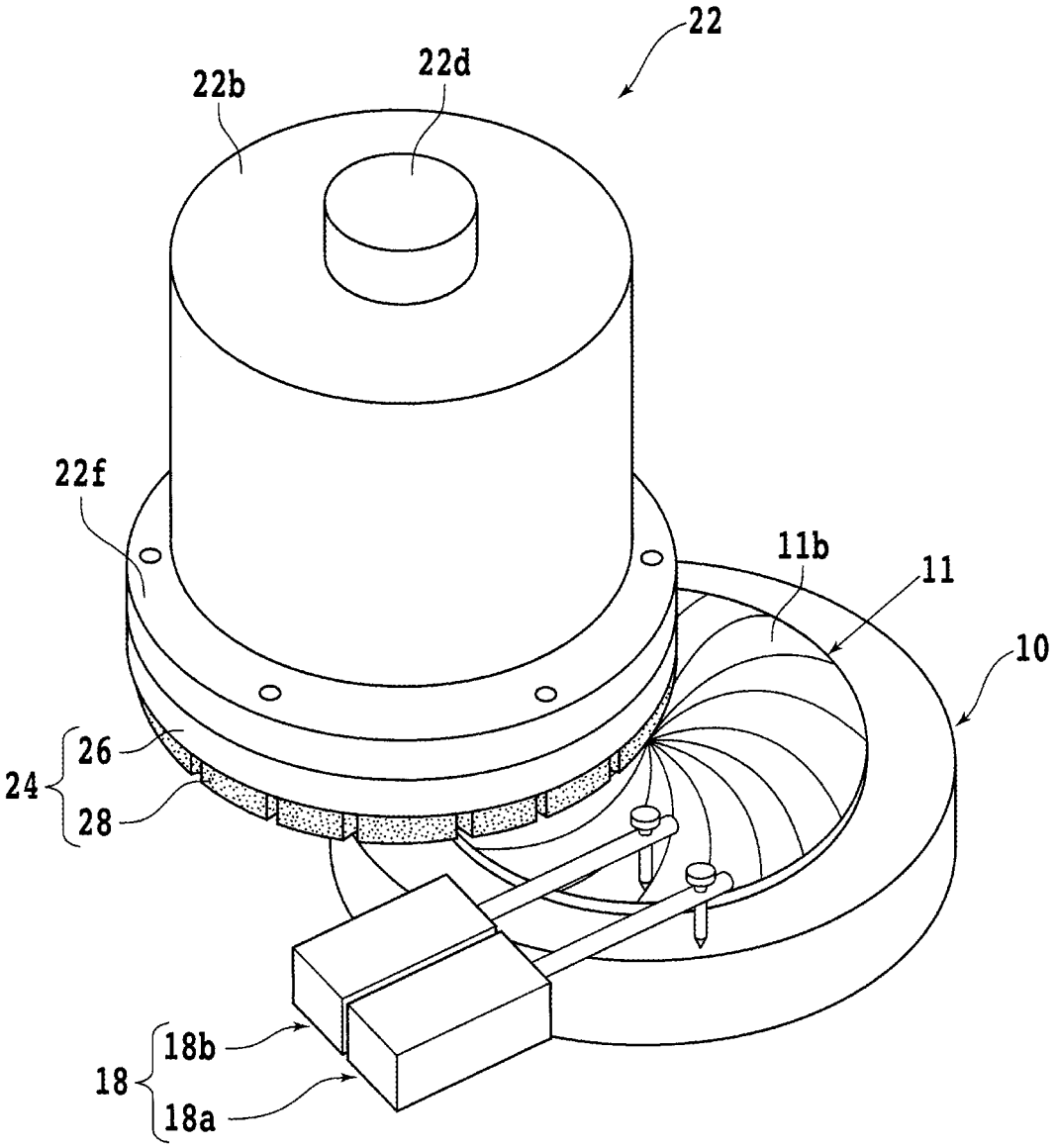
FIG. 2 is a perspective view illustrating the manner in which a workpiece is ground by grindstones of the grinding apparatus.

A preferred embodiment of the present invention will be described hereinbelow with reference to the accompanying drawings. FIG. 1 illustrates in cross section a grinding apparatus 2 that is used in the present embodiment for carrying out a method of grinding a workpiece, i.e., a grinding method, according to the present embodiment, and FIG. 2 illustrates in perspective the manner in which a plate-shaped workpiece 11 is ground on the grinding apparatus 2. The grinding apparatus 2 has a base 4 shaped as a rectangular parallelepiped that supports a plurality of components of the grinding apparatus 2.

A chuck table 10 for holding the workpiece 11 thereon is disposed on the base 4. The chuck table 10 includes a cylindrical or disk-shaped frame 10*a* made of ceramic or metal, typically stainless steel, for example. The frame 10*a* has a recess defined in an upper surface thereof and having a circular opening at its upper end.

The chuck table 10 also includes a disk-shaped holding plate 10*b* made of a porous material such as ceramic and fixedly disposed in the recess in the frame 10*a*. The holding plate 10*b* has an upper surface 10*c* shaped as a conical side surface, for example. The frame 10*a* has a fluid channel, not depicted, defined therein and having an end open at the bottom of the recess. The fluid channel has an opposite end connected to a suction source, not depicted, such as an ejector, through a valve, not depicted, or the like.

In other words, the holding plate 10*b* has a lower surface connected to the suction source through the fluid channel in the frame 10*a* and the valve or the like. When the workpiece 11 is placed on the upper surface 10*c* of the holding plate 10*b*, the valve is opened, and the suction source is actuated, the suction source generates and applies a negative pressure through the valve and the fluid channel to the lower surface of the holding plate 10*b*, through which the negative pressure is transmitted to the lower surface of the workpiece 11 to thereby attract the workpiece 11 under suction to the chuck table 10. The upper surface 10*c* of the holding plate 10*b* thus functions as a holding surface for holding the workpiece 11 under suction thereon.

A disk-shaped table base 12 is fixed to the lower surface of the frame 10*a*. The table base 12 has a lower portion connected to a rotary actuator 14 such as an electric motor. Therefore, the chuck table 10 is coupled to the rotary actuator 14 by the table base 12. When the rotary actuator 14 is energized, it rotates the chuck table 10 about a rotational axis 10*d* that extends through the center of the holding surface of the chuck table 10, i.e., the upper surface 10*c* of the holding plate 10*b*.

A tilt adjustment mechanism 16 for adjusting the tilt of the table base 12 is disposed on the base 4 beneath the table base 12. The tilt adjustment mechanism 16 includes one fixed support 16*a* and two movable supports 16*b*. The fixed support 16*a* and the two movable supports 16*b* are angularly spaced at angular intervals, i.e., angular intervals of 120°, that are equal to each other in circumferential directions of the table base 12. The fixed support 16*a* and the two movable supports 16*b* have respective upper ends connected to the lower surface of the table base 12. In FIG. 1, one of the movable supports 16*b* is illustrated.

The upper end of the fixed support 16*a* has a fixed height. In contrast, the upper ends of the movable supports 16*b* have respective variable heights. The rotational axis 10*d* of the chuck table 10 has its orientation or angle adjustable in a predetermined range by varying the heights of the upper ends of the movable supports 16*b*.

A thickness measuring unit 18 is disposed in the vicinity of the chuck table 10. The thickness measuring unit 18 includes a first height measuring device 18*a* disposed over the frame 10*a* and a second height measuring device 18*b* disposed over the holding plate 10*b*. For example, when the first height measuring device 18*a* measures the height of an upper surface of the frame 10*a* and the second height measuring device 18*b* measures the height of an upper surface of the workpiece 11 held on the chuck table 10, the difference between these measured heights is calculated as the thickness of the workpiece 11.

A grinding solution supply unit 19 is also disposed in the vicinity of the chuck table 10. The grinding solution supply unit 19 includes a pipe 19*a* extending upwardly from the base 4 and a nozzle 19*b* extending generally horizontally from an upper end of the pipe 19*a* toward the rotational axis 10*d* of the chuck table 10. The pipe 19*a* has a lower end connected to a grinding solution supply source, not depicted, that stores a grinding solution such as pure water.

A support structure 6 shaped as a prismatic column extends upwardly from a side end of the base 4. A grinding feed unit 20 is mounted on a side face of the support structure 6 that faces the chuck table 10. The grinding feed unit 20 includes a pair of vertically elongate guide rails 20*a* fixed to the side face of the support structure 6 that faces the chuck table 10. A movable plate 20*b* is slidably mounted on the guide rails 20*a* for sliding movement therealong.

A nut 20*c*, which is a part of a ball screw, is mounted on a surface of the movable plate 20*b* that faces the support structure 6 and operatively threaded over a vertically elongate threaded shaft 20*d*, which is another part of the ball screw, that is rotatable about its vertical central axis. The threaded shaft 20*d* has an upper end connected to an electric motor 20*e*. When the electric motor 20*e* is energized, it rotates the threaded shaft 20*d* about its central axis, causing the nut 20*c* to move the movable plate 20*b* vertically along the guide rails 20*a* along a Z-axis illustrated in FIG. 1.

A grinding unit 22 is mounted on an opposite surface of the movable plate 20*b* that faces away from the support structure 6. The grinding unit 22 includes a bottomed hollow cylindrical casing 22*a*. The casing 22*a* has a vertical side wall fixed to the movable plate 20*b* and houses a tubular spindle housing 22*b* therein. The spindle housing 22*b* is supported on the bottom of the casing 22*a* with an optional spacer 22*c* or the like interposed therebetween.

The spindle housing 22*b* houses a cylindrical spindle 22*d* partly therein. The spindle 22*d* has an upper end connected to a rotary actuator, not depicted, such as an electric motor.

When the rotary actuator is energized, it rotates the spindle 22*d* about a rotational axis 22*e* generally parallel to its central axis.

The spindle 22*d* has a lower end portion protruding and exposed from a lower end of the spindle housing 22*b* and the bottom of the casing 22*a*. The exposed lower end portion of the spindle 22*d* has a lower end fixed to an upper circular surface of a disk-shaped mount 22*f* that has a lower circular surface opposite to the upper surface thereof and facing downwardly. A grinding wheel 24 is mounted on the lower surface of the mount 22*f*.

The grinding wheel 24 includes an annular wheel base 26 made of metal such as stainless steel or aluminum and having generally the same diameter as the mount 22*f*. The grinding wheel 24 is mounted on the mount 22*f* such that an upper annular surface of the wheel base 26 is held in contact with the circular lower surface of the mount 22*f*. The grinding wheel 24 also includes a plurality of grindstones 28 disposed in an annular array on a lower annular surface of the wheel base 26. Each of the grindstones 28 is made of abrasive grains of diamond, cubic boron nitride (cBN), or the like that are bound together by a binder such as a vitrified bond or a resinoid bond.

For grinding the workpiece 11 on the chuck table 10 with the grinding unit 22, the positional relation between the chuck table 10 and the grinding unit 22 is adjusted to bring a portion of the rotational axis 10*d* of the chuck table 10 that lies above the upper surface 10*c* of the chuck table 10 in overlapping relation to the grindstones 28 of the grinding wheel 24. When the chuck table 10 and the grinding wheel 24 are rotated about their rotational axes 10*d* and 22*e*, respectively, in order to grind the workpiece 11, the grindstones 28 successively move across the rotational axis 10*d*. When the grinding unit 22 is lowered by the grinding feed unit 20 in grinding the workpiece 11, the nozzle 19*b* is positioned inside the grinding wheel 24, i.e., inside the annular array of the grindstones 28.

Typically, the workpiece 11 includes a disk-shaped wafer made of a semiconductor such as silicon (Si). The workpiece 11 has a face side 11*a* (see FIG. 3 and the like) placed on the upper surface 10*c* of the holding plate 10*b*. The face side 11*a* has a plurality of small areas demarcated by a plurality of intersecting projected dicing lines or streets, for example, with devices such as integrated circuits (ICs) formed individually in the small areas. According to the present invention, the grinding unit 22 grinds a reverse side 11*b* (see FIGS. 2 and 3) of the workpiece 11 that faces upwardly opposite the face side 11*a*, thereby thinning down the workpiece 11.

According to the present invention, a disk-shaped wafer made of a semiconductor such as silicon is used as the workpiece 11, as described above. According to the present invention, however, the workpiece 11 is not limited to any particular materials, shapes, structural details, sizes, and the like. For example, a substrate made of a material such as another semiconductor, ceramic, resin, or metal may be used as the workpiece 11. Similarly, the devices formed on the workpiece 11 are not limited to any particular kinds, quantities, shapes, structural details, sizes, layouts, and the like. Devices may even not be formed on the workpiece 11.

The grinding method according to the present embodiment is carried out on the grinding apparatus 2 as follows: First, the workpiece 11 is held on the chuck table 10 of the grinding apparatus 2 (holding step). Specifically, the face side 11*a* of the workpiece 11 is held against the upper surface 10*c* of the holding plate 10*b*, and the suction source is actuated, and the valve is opened to cause the negative pressure generated by the suction source to act through the valve and the fluid channel on the workpiece 11 to thereby attract the face side 11*a* of the workpiece 11 under suction to the chuck table 10, with the reverse side 11*b* exposed upwardly. A protective member or the like for protecting the devices on the workpiece 11 may be affixed in advance to the face side 11*a* of the workpiece 11.

Figure 3:
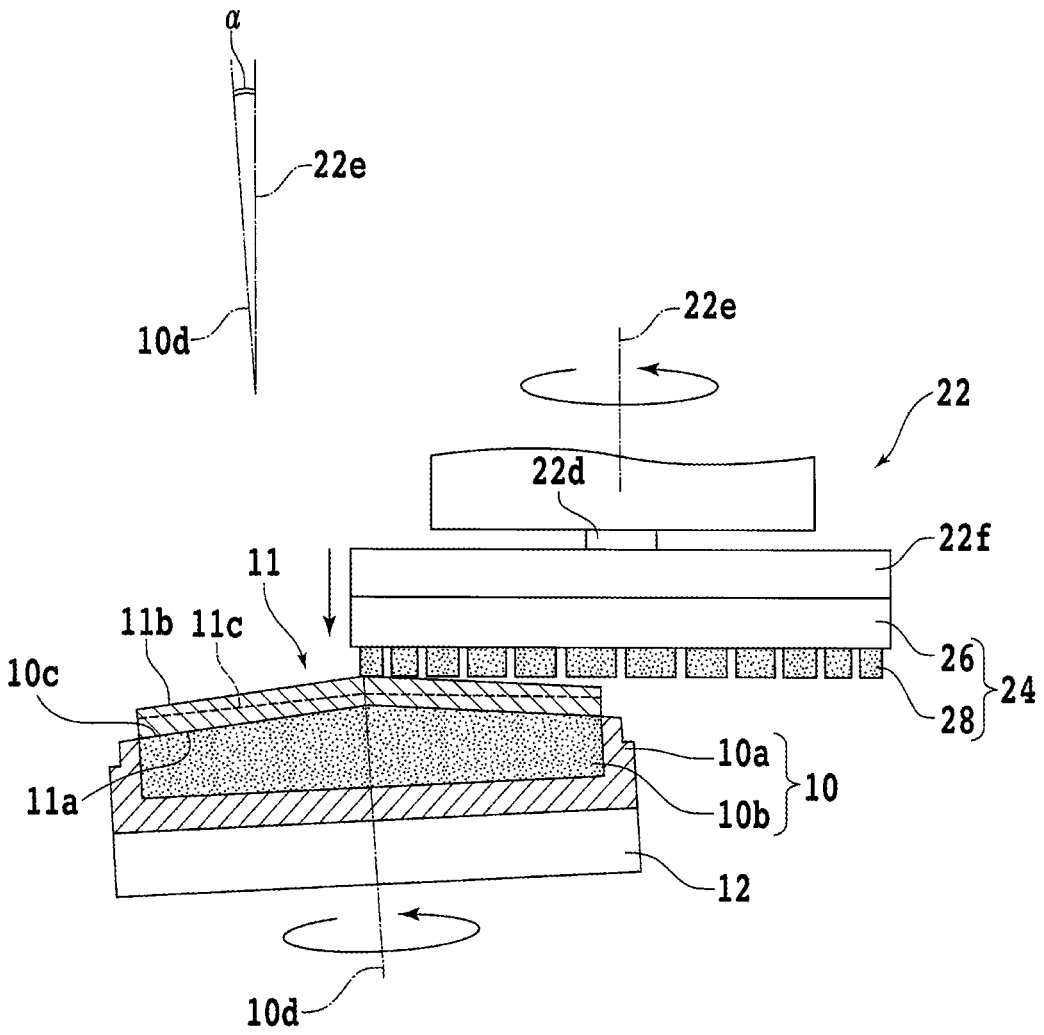
FIG. 3 is a cross-sectional view illustrating the manner in which the workpiece is ground under a first condition.

After the workpiece 11 has thus been held on the chuck table 10, the workpiece 11 is ground under a first condition (first grinding step). FIG. 3 illustrates in cross section the manner in which the workpiece 11 is ground under the first condition. In FIG. 3, the reverse side 11*c* of the workpiece 11 after it has been ground under the first condition is indicated by broken lines. Specifically, the positional relation between the chuck table 10 and the grinding unit 22 is adjusted to position one of the grindstones 28 above the center of the chuck table 10, for example.

Also, the tilt adjustment mechanism 16 adjusts the tilt of the chuck table 10 such that the distance between the grindstone 28 positioned at the center of the chuck table 10 and the holding plate 10*b* is smaller than the distance between those grindstones 28 that are positioned in an outer circumferential region of the chuck table 10 and the holding plate 10*b*. In other words, the relative tilt of the chuck table 10 and the grinding wheel 24 is adjusted to a first state in which the distances between the upper surface 10*c* of the holding plate 10*b* and the lower surfaces of the grindstones 28 are larger in other positions than the position where the grindstones 28 overlap the rotational axis 10*d* of the chuck table 10.

The relative tilt of the chuck table 10 and the grinding wheel 24 is optionally set to a specific value depending on total thickness variations (TTV) and the like required for the workpiece 11 after it has been ground. According to the present embodiment, the relative tilt of the chuck table 10 and the grinding wheel 24 is adjusted to keep an angle $\alpha$ formed between the rotational axis 10*d* of the chuck table 10 and the rotational axis 22*e* of the spindle 22*d* in a range from substantially 0° to 0.004°, preferably is of a value of substantially 0.0034°.

Thereafter, while both the chuck table 10 and the grinding wheel 24 are being rotated, the grinding feed unit 20 lowers the grinding wheel 24 to move the upper surface 10*c* of the holding plate 10*b* and the grindstones 28 relatively closer to each other. The grinding feed unit 20 continuously lowers the grinding wheel 24 to bring the grindstones 28 into abrasive contact with the workpiece 11 on the holding plate 10*b*, thereby grinding the reverse side 11*b* of the workpiece 11. At the time of grinding the workpiece 11, the grindstones 28 successively move across the rotational axis 10*d* of the chuck table 10.

The speed at which the chuck table 10 is rotated, the speed at which the grinding wheel 24 is rotated, and the speed at which the grinding wheel 24 is lowered, i.e., the speed at which the upper surface 10*c* of the holding plate 10*b* and the grindstones 28 are moved relatively closer to each other, are optionally set to values depending on the surface roughness required for the workpiece 11 after it has been ground, i.e., the surface roughness required for the central portion of the workpiece 11 after it has been ground. According to the present embodiment, the chuck table 10 is rotated at a speed in the range from 100 rpm to 900 rpm, the grinding wheel 24 is rotated at a speed in the range from 1000 rpm to 3000 rpm, and the grinding wheel 24 is lowered at a speed in the range from 1.5 μm/s to 5.0 μm/s.

Figure 4:
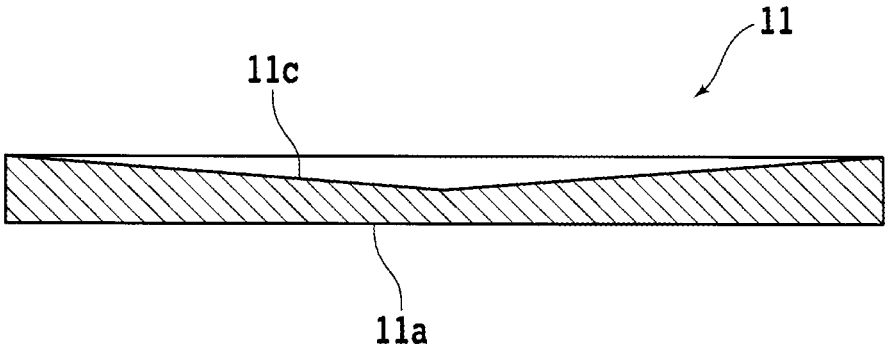
FIG. 4 is a cross-sectional view illustrating the workpiece that has been ground under the first condition.

The upper surface 10*c* of the holding plate 10*b* and the grindstones 28 are moved relatively closer to each other until the workpiece 11 is ground to a desired thickness. FIG. 4 illustrates in cross section the workpiece 11 that has been ground under the first condition. As described above, the relative tilt of the chuck table 10 and the grinding wheel 24 is adjusted to the first state in which the angle α is formed between the rotational axis 10*d* of the chuck table 10 and the rotational axis 22*e* of the spindle 22*d*. The central portion of the workpiece 11 that has been ground under the first condition including the first state is thinner than the outer circumferential portion of the workpiece 11.

Figure 5:
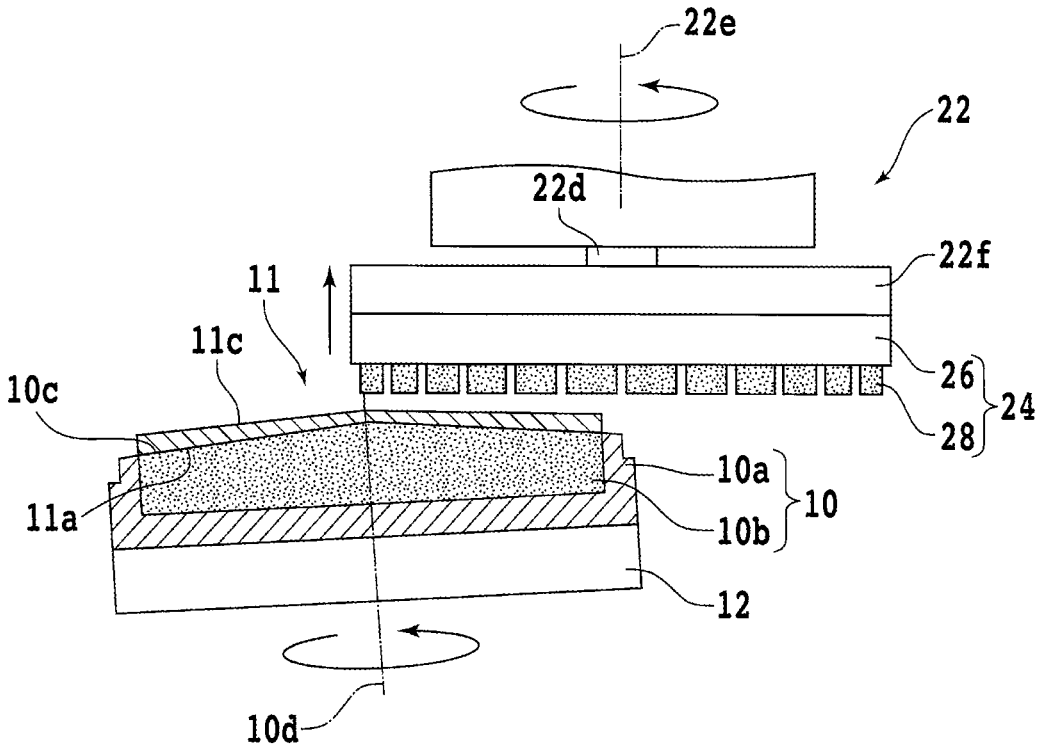
FIG. 5 is a cross-sectional view illustrating the manner in which the grindstones have been spaced from the workpiece.

After the workpiece 11 has been ground under the first condition, the grindstones 28 are spaced upwardly from the workpiece 11, thereby stopping grinding the workpiece 11 (grinding stopping step). FIG. 5 illustrates in cross section the manner in which the grindstones 28 have been spaced from the workpiece 11. Specifically, the grinding feed unit 20 lifts the grinding wheel 24 to space the upper surface 10*c* of the holding plate 10*b* and the grindstones 28 relatively from each other. The grinding wheel 24 may be lifted a distance ranging from substantially 10 μm to 100 μm.

Figure 6:
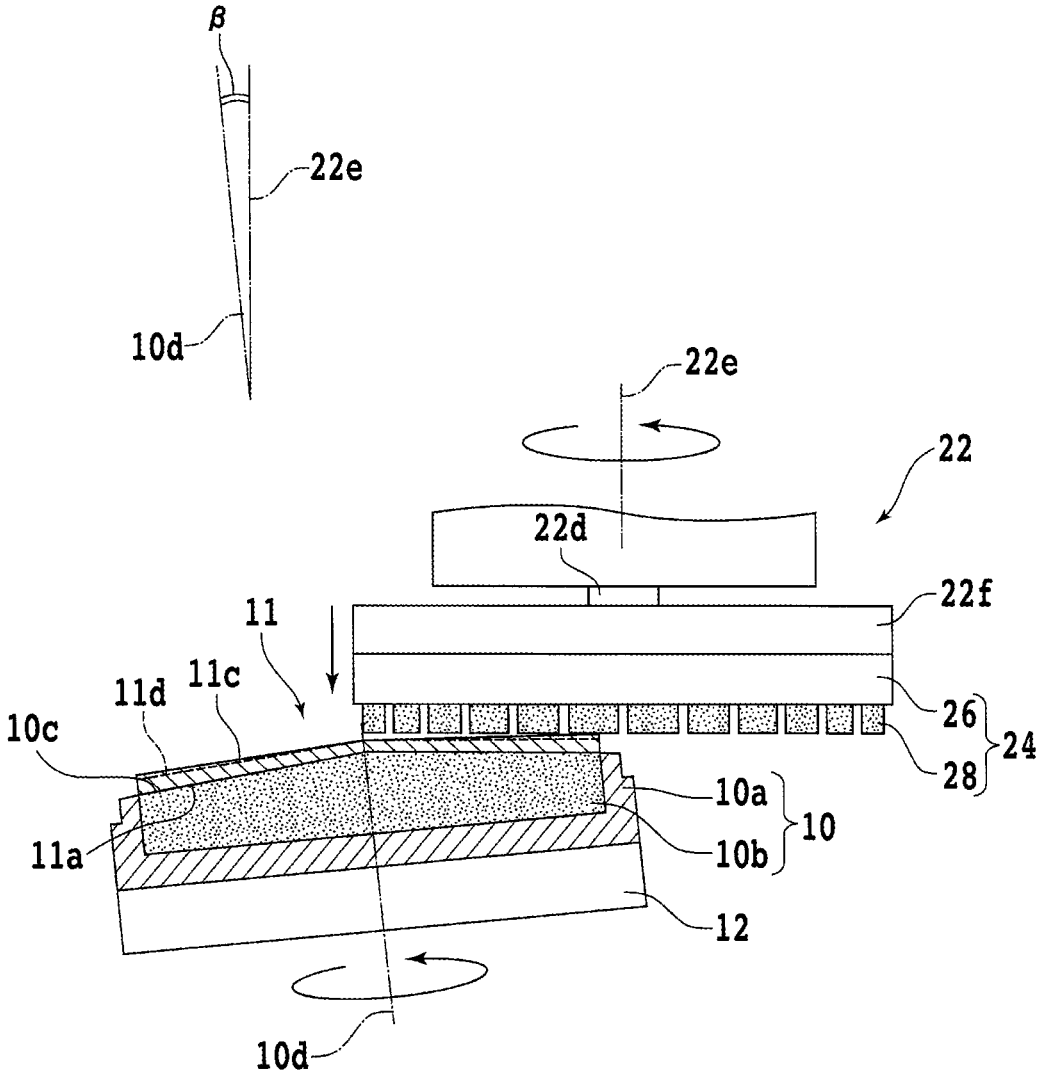
FIG. 6 is a cross-sectional view illustrating the manner in which the workpiece is ground under a second condition.

After the grinding of the workpiece 11 is stopped, the workpiece 11 is ground under a second condition that is different from the first condition (second grinding step). FIG. 6 illustrates in cross section the manner in which the workpiece 11 is ground under the second condition. In FIG. 6, the reverse side 11*d* of the workpiece 11 after it has been ground under the second condition is indicated by broken lines.

Specifically, the tilt adjustment mechanism 16 adjusts the tilt of the chuck table 10 such that the distance between the grindstone 28 positioned at the center of the chuck table 10 and the workpiece 11 is larger than the distance between those grindstones 28 that are positioned in the outer circumferential region of the chuck table 10 and the workpiece 11. In other words, the relative tilt of the chuck table 10 and the grinding wheel 24 is adjusted to a second state, which is different from the first state, in which the grindstones 28 are held out of contact with the workpiece 11 at the position where the grindstones 28 overlap the rotational axis 10*d* of the chuck table 10.

The relative tilt of the chuck table 10 and the grinding wheel 24 is optionally set to a specific value depending on TTV and the like required for the workpiece 11 after it has been ground. According to the present embodiment, the relative tilt of the chuck table 10 and the grinding wheel 24 is adjusted to keep an angle β formed between the rotational axis 10*d* of the chuck table 10 and the rotational axis 22*e* of the spindle 22*d* in a range from substantially 0.007° to 0.012°, preferably is of a value of substantially 0.008°.

Thereafter, while both the chuck table 10 and the grinding wheel 24 are being rotated, the grinding feed unit 20 lowers the grinding wheel 24 to move the upper surface 10*c* of the holding plate 10*b* and the grindstones 28 relatively closer to each other. The grinding feed unit 20 continuously lowers the grinding wheel 24 to bring the grindstones 28 into abrasive contact with the workpiece 11 on the holding plate 10*b*, thereby grinding the reverse side 11*b* of the workpiece 11. Also at the time of grinding the workpiece 11, the grindstones 28 successively move across the rotational axis 10*d* of the chuck table 10.

In an in-feed grinding mode thus applied to the grinding method according to the present embodiment, the outer circumferential portion of the workpiece 11 moves faster than the central portion thereof upon rotation of the chuck table 10. Consequently, the volume of the material ground off the outer circumferential portion of the workpiece 11 is larger than the volume of the material ground off the central portion of the workpiece 11. As a result, when the workpiece 11 is ground under the first condition described above, the surface roughness of the outer circumferential portion of the workpiece 11 is larger than the surface roughness of the central portion of the workpiece 11.

According to the present embodiment, the outer circumferential portion of the workpiece 11 is ground under the second condition that is different from the first condition in order to reduce the difference between the surface roughness of the central portion of the workpiece 11 and the surface roughness of the outer circumferential portion of the workpiece 11. For example, either one of the speed at which the chuck table 10 is rotated, the speed at which the grinding wheel 24 is rotated, and the speed at which the grinding wheel 24 is lowered, i.e., the speed at which the upper surface 10*c* of the holding plate 10*b* and the grindstones 28 are moved relatively closer to each other, is adjusted to be able to make the surface roughness of the outer circumferential portion of the workpiece 11 smaller than that when the workpiece 11 is ground under the first condition.

In a case where only the speed at which the chuck table 10 is rotated is to be adjusted, the second condition is established to rotate the chuck table 10 at a lower speed than that when the workpiece 11 is ground under the first condition. Specifically, the chuck table 10 is rotated at a speed that is ⅓ or less of the speed under the first condition, typically at a speed ranging from 30 rpm to 300 rpm. The speed at which the grinding wheel 24 is rotated and the speed at which the grinding wheel 24 is lowered may be the same as those under the first condition.

In a case where only the speed at which the grinding wheel 24 is rotated is to be adjusted, the second condition is established to rotate the grinding wheel 24 at a higher speed than that when the workpiece 11 is ground under the first condition. Specifically, the grinding wheel 24 is rotated at a speed that is twice or more the speed under the first condition, typically at a speed ranging from 2000 rpm to 6000 rpm. The speed at which the chuck table 10 is rotated and the speed at which the grinding wheel 24 is lowered may be the same as those under the first condition.

In a case where only the speed at which the grinding wheel 24 is lowered is to be adjusted, the second condition is established to lower the grinding wheel 24 at a lower speed, i.e., to move the upper surface 10*c* of the holding plate 10*b* and the grindstones 28 relatively closer to each other at a lower speed than when the workpiece 11 is ground under the first condition. Specifically, the grinding wheel 24 is lowered at a speed that is ⅕ or less of the speed under the first condition, typically at a speed ranging from 0.3 μm/s to 1.0 μm/s. The speed at which the chuck table 10 is rotated and the speed at which the grinding wheel 24 is rotated may be the same as those under the first condition.

By grinding the workpiece 11 under the second condition thus established, the surface roughness of the outer circumferential portion of the workpiece 11 after it has been ground is controlled to fall within a range of ±20% of the surface roughness of the central portion of the workpiece 11, thereby reducing the difference between the surface roughness of the central portion of the workpiece 11 and the surface roughness of the outer circumferential portion of the workpiece 11. According to the present embodiment, either one of a plurality of items representing the speed at which the chuck table 10 is rotated, the speed at which the grinding wheel 24 is rotated, and the speed at which the grinding wheel 24 is lowered is varied from the first condition. However, more than one of these items may be varied to reduce the difference between the surface roughness of the central portion of the workpiece 11 and the surface roughness of the outer circumferential portion of the workpiece 11.

Figure 7:
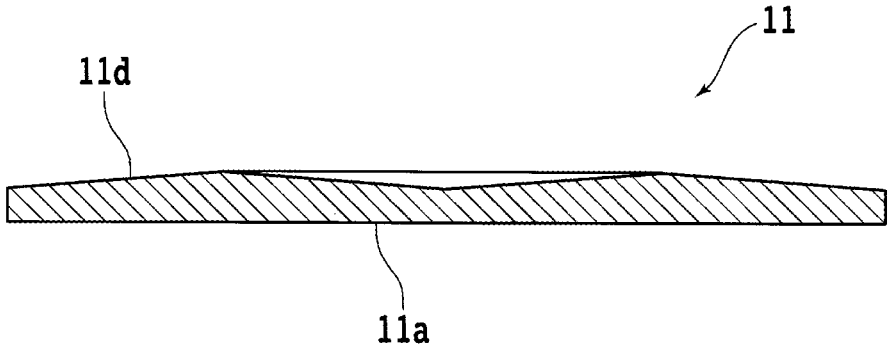
FIG. 7 is a cross-sectional view illustrating the workpiece that has been ground under the second condition.

The upper surface 10*c* of the holding plate 10*b* and the grindstones 28 are moved relatively closer to each other until the workpiece 11 is ground to a desired thickness. FIG. 7 illustrates in cross section the workpiece 11 that has been ground under the second condition. As described above, the relative tilt of the chuck table 10 and the grinding wheel 24 is adjusted to the second state in which the angle β is formed between the rotational axis 10*d* of the chuck table 10 and the rotational axis 22*e* of the spindle 22*d*. Therefore, the outer circumferential portion of the workpiece 11 that has been ground under the second condition including the second state is thinner than the outer circumferential portion of the workpiece 11 before it is ground under the second condition.

On the other hand, the thickness of the central portion of the workpiece 11 that has been ground under the second condition remains the same as the thickness of the outer circumferential portion of the workpiece 11 before it is ground under the second condition. In other words, the central portion of the workpiece 11 is not ground under the second condition. Consequently, the surface roughness of the outer circumferential portion of the workpiece 11 can be adjusted to a smaller level, independently of the surface roughness of the central portion of the workpiece 11.

If an excessively wide region of the workpiece 11 is processed by being ground under the second condition, then it is not possible to adequately adjust the surface roughness of the outer circumferential portion of the workpiece 11 and the surface roughness of the central portion of the workpiece 11. Similarly, if an excessively narrow region of the workpiece 11 is processed by being ground under the second condition, then it is not possible to adequately adjust the surface roughness of the outer circumferential portion of the workpiece 11 and the surface roughness of the central portion of the workpiece 11 is processed.

Accordingly, when the workpiece 11 is ground under the second condition, it is preferable to process a region of the workpiece 11 whose distance from the outer circumferential edge of the workpiece 11 ranges from ⅓ to ⅔ of the radius of the workpiece 11, and more preferable to process a region of the workpiece 11 whose distance from the outer circumferential edge of the workpiece 11 ranges from ⅖ to ⅗ of the radius of the workpiece 11. According to the present embodiment, when the workpiece 11 is ground under the second condition, a region of the workpiece 11 whose distance from the outer circumferential edge of the workpiece 11 is substantially ½ of the radius of the workpiece 11.

As described above, in the in-feed grinding mode in which both the chuck table 10 and the grinding wheel 24 are rotated such that the grindstones 28 successively move across the rotational axis 10*d* of the chuck table 10, the volume of the material ground off the outer circumferential portion of the workpiece 11 per unit time is larger than the volume of the material ground off the central portion of the workpiece 11 per unit time. Consequently, after the workpiece 11 has been ground, the surface roughness of the outer circumferential portion of the workpiece 11 tends to be larger than the surface roughness of the central portion of the workpiece 11.

In the grinding method according to the present embodiment, therefore, the relative tilt of the chuck table 10 and the grinding wheel 24 is adjusted to the first state, and then the workpiece 11 is ground so as to make the central portion thereof thinner (first grinding step). Thereafter, the relative tilt of the chuck table 10 and the grinding wheel 24 is adjusted to the second state that is different from the first state, and then the workpiece 11 is ground so as not to remove the central portion thereof (second grinding step).

In the second grinding step, furthermore, the workpiece 11 is ground under the condition, i.e., the second condition, for making the surface roughness smaller than in the first grinding step. This makes it possible to adjust the surface roughness of the outer circumferential portion of the workpiece 11 to a smaller level, independently of the surface roughness of the central portion of the workpiece 11. Therefore, the grinding method according to the present embodiment can reduce the difference between the surface roughness of the central portion of the workpiece 11 and the surface roughness of the outer circumferential portion of the workpiece 11, compared with conventional grinding methods.

The present invention is not limited to the details according to the embodiment described above and can be implemented in various modifications. For example, according to the above embodiment, the workpiece 11 is ground to process the reverse side 11*b* thereof into a recessed configuration in the first grinding step, and is then ground to process the reverse side 11*b* thereof into a projecting configuration in the second grinding step. In the second grinding step, however, the workpiece 11 can be ground to process the reverse side 11*b* thereof into a flat configuration.

Figure 8:
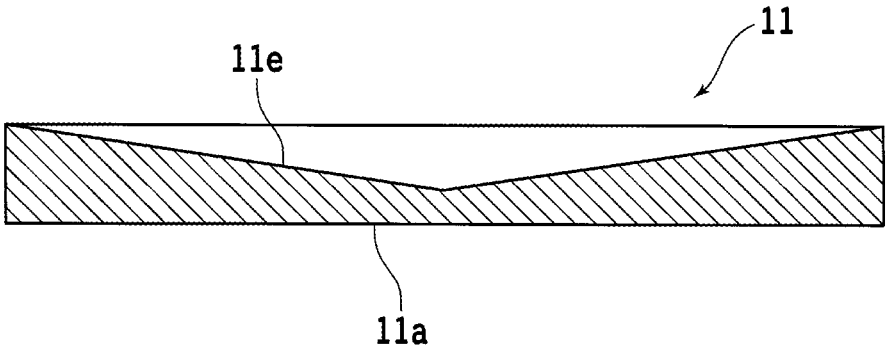
FIG. 8 is a cross-sectional view illustrating the workpiece that has been ground under a first condition according to a modification.
Figure 9:
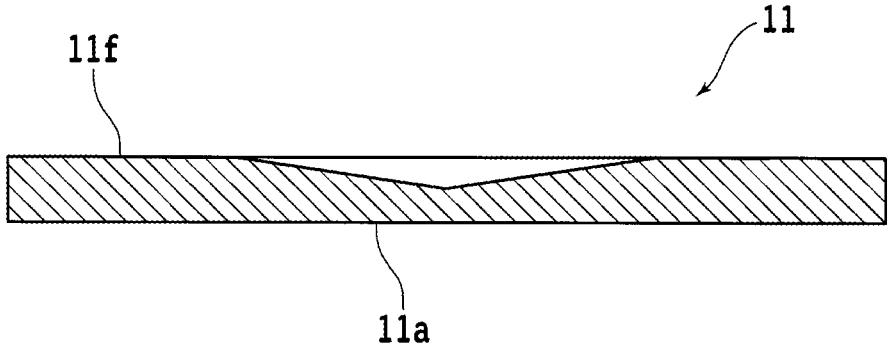
FIG. 9 is a cross-sectional view illustrating the workpiece that has been ground under a second condition according to the modification.

FIG. 8 illustrates in cross section the workpiece 11 that has been ground under a first condition according to a modification. FIG. 9 illustrates in cross section the workpiece 11 that has been ground under a second condition according to the modification. FIG. 8 illustrates a reverse side 11*e* of the workpiece 11 after it has been ground under the first condition according to the modification. FIG. 9 illustrates a reverse side 11*f* of the workpiece 11 after it has been ground under the second condition according to the modification.

Under the second condition according to the modification, the angle β formed between the rotational axis 10*d* of the chuck table 10 and the rotational axis 22*e* of the spindle 22*d* is essentially zero. On the other hand, under the first condition according to the modification, the angle α formed between the rotational axis 10*d* of the chuck table 10 and the rotational axis 22*e* of the spindle 22*d* is larger than the angle α according to the above embodiment. Other specific conditions, i.e., the first condition and the second condition, may be the same as those according to the first embodiment. The present modification makes it possible to achieve the same TTV and surface roughness as those achieved by the grinding method according to the above embodiment.

In the first grinding step, the workpiece 11 may be ground under a condition for processing the reverse side 11*b* thereof into a flat configuration, and in the second grinding step, the workpiece 11 may be ground under a condition for processing the reverse side 11*b* thereof into a projecting configuration. Under these conditions, sufficiently obtained is such an effect that, while it is difficult to increase the quality of the TTV, the difference between the surface roughness of the central portion of the workpiece 11 and the surface roughness of the outer circumferential portion of the workpiece 11 is reduced. Accordingly, these conditions may be applied to cases where they are tolerable by the quality of workpieces desired, or the like.

Besides, a structure, a method, and the like according to the above embodiment and modification may be appropriately modified, and various modifications can be implemented without departing from the scope of the object of the present invention.

The present invention is not limited to the details of the above described preferred embodiment. The scope of the invention is defined by the appended claims and all changes and modifications as fall within the equivalence of the scope of the claims are therefore to be embraced by the invention.

What is claimed is:

1. A method of grinding a plate-shaped workpiece held on a holding surface of a chuck table with a grinding wheel having a plurality of grindstones disposed in an annular array while the chuck table and the grinding wheel are being rotated with the grindstones moving across a rotational axis of the chuck table, the method comprising:

a first grinding step of adjusting a relative tilt of the chuck table and the grinding wheel to a first state in which distances between the grindstones and the holding surface are larger in other positions than a position where the grindstones overlap the rotational axis of the chuck table, and moving the holding surface and the grindstones relatively closer to each other to bring the grindstones into abrasive contact with the workpiece to thereby grind the workpiece;

a grinding stopping step of spacing the grindstones from the workpiece to stop grinding the workpiece, after the first grinding step; and a second grinding step of adjusting the relative tilt of the chuck table and the grinding wheel to a second state, which is different from the first state, in which the grindstones are held out of contact with the workpiece at a position where the grindstones overlap the rotational axis of the chuck table, and moving the holding surface and the grindstones relatively closer to each other to bring the grindstones into abrasive contact with the workpiece to thereby grind an outer circumferential portion of the workpiece, without grinding a central portion of the workpiece, wherein the second grinding step is performed after the grinding stopping step, wherein, in the second grinding step, the workpiece is ground under a condition for causing the workpiece to have a smaller surface roughness than that in the first grinding step.

2. The method according to claim 1, wherein the chuck table is rotated at a lower speed in the second grinding step than that in the first grinding step.

3. The method according to claim 1, wherein the grinding wheel is rotated at a higher speed in the second grinding step than that in the first grinding step.

4. The method according to claim 1, wherein the holding surface and the grindstones are moved closer to each other at a lower speed in the second grinding step than that in the first grinding step.

5. A method of grinding a plate-shaped workpiece held on a holding surface of a chuck table with a grinding wheel having a plurality of grindstones disposed in an annular array while the chuck table and the grinding wheel are being rotated with the grindstones moving across a rotational axis of the chuck table, the method comprising:

a first grinding step of adjusting a relative tilt of the chuck table and the grinding wheel to a first state in which distances between the grindstones and the holding surface are larger in other positions than a position where the grindstones overlap the rotational axis of the chuck table, and moving the holding surface and the grindstones relatively closer to each other to bring the grindstones into abrasive contact with the workpiece to thereby grind the workpiece;

a grinding stopping step of spacing the grindstones from the workpiece to stop grinding the workpiece, after the first grinding step; and a second grinding step of adjusting the relative tilt of the chuck table and the grinding wheel to a second state, which is different from the first state, in which the grindstones are held out of contact with the workpiece at a position where the grindstones overlap the rotational axis of the chuck table, and moving the holding surface and the grindstones relatively closer to each other to bring the grindstones into abrasive contact with the workpiece to thereby grind the workpiece, after the grinding stopping step, wherein, in the second grinding step, the workpiece is ground under a condition for causing an outer circumferential portion of the workpiece to have a smaller surface roughness than created on a central portion of the workpiece during the first grinding step.

6. The method according to claim 5, wherein the chuck table is rotated at a lower speed in the second grinding step than that in the first grinding step.

7. The method according to claim 5, wherein the grinding wheel is rotated at a higher speed in the second grinding step than that in the first grinding step.

8. The method according to claim 5, wherein the holding surface and the grindstones are moved closer to each other at a lower speed in the second grinding step than that in the first grinding step.

9. The method according to claim 1, wherein the outer circumferential portion of the workpiece that is ground during the second grinding step extends from an outer circumferential edge of the workpiece to an area that is spaced from the outer circumferential edge by at least ⅓ of the radius of the workpiece but not more than ⅔ of the radius of the workpiece.

10. The method according to claim 1, wherein the outer circumferential portion of the workpiece that is ground during the second grinding step extends from an outer circumferential edge of the workpiece to an area that is spaced from the outer circumferential edge by about ½ of the radius of the workpiece.

11. The method according to claim 5, wherein the outer circumferential portion of the workpiece that has the smaller surface roughness extends from an outer circumferential edge of the workpiece to an area that is spaced from the outer circumferential edge by at least ⅓ of the radius of the workpiece but not more than ⅔ of the radius of the workpiece.

12. The method according to claim 5, wherein the outer circumferential portion of the workpiece that that has the smaller surface roughness extends from an outer circumferential edge of the workpiece to an area that is spaced from the outer circumferential edge by about ½ of the radius of the workpiece.

* * * * *